United States Patent [19]

Suarez et al.

[11] Patent Number: 5,032,190

[45] Date of Patent: Jul. 16, 1991

[54] SHEET PROCESSING FOR ODS IRON-BASE ALLOYS

[75] Inventors: Francis S. Suarez; James D. Vandevender, both of Huntington; Vernon L. Maynard, Kenova, all of W. Va.

[73] Assignee: Inco Alloys International, Inc., Huntington, W. Va.

[21] Appl. No.: 513,899

[22] Filed: Apr. 24, 1990

[51] Int. Cl.[5] ..... C22C 1/00; C21D 8/00

[52] U.S. Cl. ..... 148/11.5 R; 148/12 R; 148/155; 148/308; 428/614

[58] Field of Search ..... 148/11.5 R, 12 R, 155, 148/308; 428/614

[56] References Cited

U.S. PATENT DOCUMENTS

| | | | |
|---|---|---|---|
| 3,992,162 | 11/1976 | Cairns et al. | 29/182.5 |
| 4,075,010 | 2/1978 | Fischer | 75/235 |
| 4,244,736 | 1/1981 | Day | 420/40 |
| 4,318,758 | 3/1982 | Kuroki et al. | 148/308 |
| 4,462,844 | 7/1984 | Takahashi et al. | 148/11.5 R |
| 4,531,981 | 7/1985 | Singer | 148/11.5 |
| 4,537,643 | 8/1985 | Thomas et al. | 148/155 |
| 4,559,090 | 12/1985 | Grützner | 148/11.5 R |
| 4,655,854 | 4/1987 | Nishike et al. | 148/308 |
| 4,732,622 | 3/1988 | Jones | 148/11.5 |
| 4,871,400 | 10/1989 | Shindo et al. | 148/12.7 B |
| 4,885,042 | 12/1989 | Kenmochi et al. | 148/156 |

*Primary Examiner*—Upendra Roy

*Attorney, Agent, or Firm*—Francis J. Mulligan, Jr.; Edward A. Steen; Blake T. Biederman

[57] ABSTRACT

The process of the invention provides an improved method for forming sheet of iron-base ODS alloys. Powder containing iron and a substantially uniformly distributed oxide dispersoid is hot compacted into a billet. The billet is hot rolled in a first direction to introduce a predetermined amount of cold work into said billet. The hot rolled billet is then cold rolled in a second direction substantially perpendicular to said first direction after the hot rolling to form the iron-base ODS sheet. The cold rolling also introduces a predetermined amount of cold work into the billet. Preferably, the hot rolling and cold rolling are balanced to produce substantially uniform properties in the transverse and longitudinal directions.

12 Claims, 2 Drawing Sheets

SHEET PROCESSING FOR ODS IRON-BASE ALLOYS

FIELD OF INVENTION

This invention is related to oxide dispersion strengthened (ODS) iron-base alloys. More particularly, this invention is related to an improved method of forming mechanically alloyed oxide dispersion strengthened sheet.

BACKGROUND OF THE INVENTION

Iron-base oxide dispersion strengthened alloys (iron-base ODS alloys) have been developed for high temperature applications. Chromium and aluminum is typically added to the iron-base for resistance to oxidation, carburization and hot corrosion. The alloy is strengthened with an oxide stable at high temperature, such as a yttrium oxide. The oxide is uniformly distributed throughout the alloy as a finely distributed dispersoid. Iron-base ODS alloys in the form of sheet are particularly useful for gas-turbine combustion chambers, components of advanced energy-conversion systems and high temperature vacuum furnaces.

The properties of sheet of iron-base ODS alloys are extremely process dependent and process sensitive. Ideally, iron-base ODS sheet is formed having a pancake-shaped grain structure. The pancake-shaped grain structure contributes to isotropic properties in both the longitudinal and transverse properties of sheet. For purposes of this invention, transverse direction refers to transverse to the last rolling direction and longitudinal refers to in the rolling direction. For turbine engine parts it is often critical to have substantially uniform properties in the transverse and longitudinal directions. The problem with processing iron-base ODS sheet is that the properties are direction dependent. When material is processed in only one direction, the properties in the longitudinal direction are disproportionately increased in relation to the transverse direction.

To date, iron-base ODS alloys have been produced by a low yield multi-step process. First, the alloy was prepared by ball milling powder. The powder was then encased in steel cladding to form a billet. The billet was extruded and hot rolled. A pickling operation was then used to remove the can. To finish the sheet, the sheet was then cold rolled to final size. Cold rolling at temperatures slightly above room temperature may be required because iron-base ODS alloys often have a high ductile-to-brittle transition temperature. At these cold rolling temperatures very little, if any, recrystallization occurs.

In order to optimize the isotropic properties in the transverse and longitudinal directions, iron-base ODS alloys are cross-rolled. The cross-rolling is accomplished by rolling in a first direction, rotating the sheet 90° and rolling. After each significant reduction in thickness, the sheet is rotated 90°. To accomplish these multiple turns, a hand-mill is used to roll the sheet down to finished size. The problem with these hand-mill operations is the process is limited by width of the mill each time a sheet is rotated 90°. In addition, this process is labor intensive and has produced maximum product yields of only 25%.

It is an object of the invention to provide a more continuous and automated method for producing iron-base ODS sheet having predetermined properties in the transverse and longitudinal directions.

It is further object of the invention to increase production yields.

It is a further object of the invention to produce ODS sheet of larger width and length having improved mechanical properties.

SUMMARY OF THE INVENTION

The process of the invention provides an improved method for forming sheet of iron-base ODS alloys. Powder containing iron and a substantially uniformly distributed oxide dispersoid is hot compacted into a billet. The billet is hot rolled in a first direction to introduce a predetermined amount of work hardening in said billet. The hot rolled billet is then cold rolled in a second direction substantially perpendicular to said first direction after the hot rolling to form the iron-base ODS sheet. The cold rolling also introduces a predetermined amount of work hardening in the billet. Preferably, the hot rolling and cold rolling are balanced to produce substantially uniform properties in the transverse and longitudinal directions.

For purposes of this specification and claims, the term "hot rolling" or "hot working" does not have the conventional metallurgical meaning of rolling or working at a temperature above the recrystallization temperature. Generally speaking, with an iron-base ODS alloy, true hot working with recrystallization to a large grain size can occur only in a very narrow temperature range immediately below the melting point of the alloy. Below the temperature range of true hot working, which range can vary with strain, lies a range of quasi hot working in which recrystallization can occur to produce a very fine grain. Below that range lies the range of warm working in which, depending on the temperature varying degrees of work hardening and work softening occurs. Finally, at the lower end of the temperature scale in the cold working zone only work hardening occurs during deformation. As used in the present specification and claims the term "hot rolling" is used to designate work deforming at a temperature at which work hardening occurs simultaneously with work softening or relaxation so as to impart work hardening to the alloy being deformed.

DESCRIPTION OF PREFERRED EMBODIMENT

Figure 1:
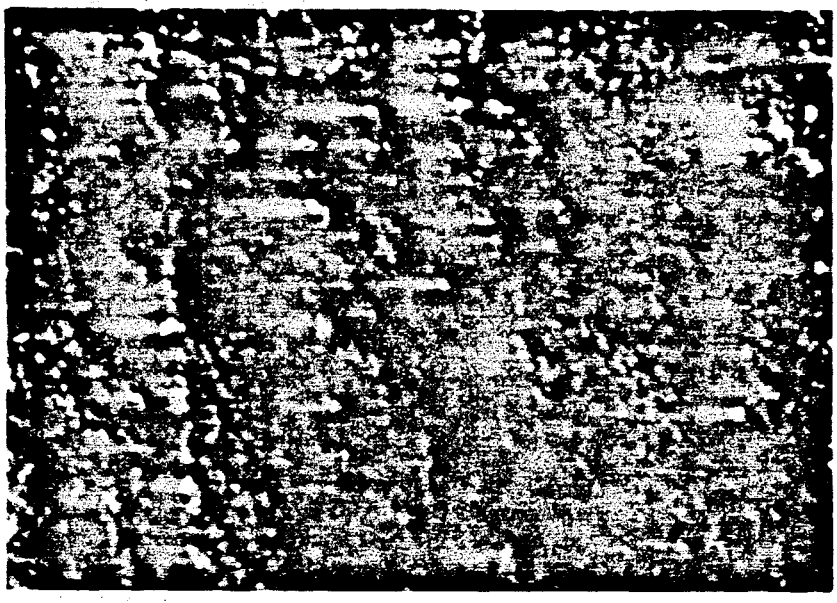
FIG. 1 is a scanning electron microscope (SEM) photomicrograph of an annealed iron-base ODS alloy, taken at 2600X, illustrating a dark oxide surface layer.

The method of the invention has produced a significant advance in the art of processing iron-base ODS alloys. A semicontinuous process of rolling iron-base ODS sheet has been developed having controlled properties in the transverse and longitudinal directions. The process yield has increased from 25% up to 63%. In addition, transverse and longitudinal properties have been balanced and improved.

In particular, the method of the invention has been successfully performed on a relatively complicated alloy known as alloy MA 956. Alloy MA 956 is an iron-base ODS alloy having the following nominal composition in weight percent:

Iron: 74
Chromium: 20
Aluminum: 4.5
Titanium: 0.5
Yttrium Oxide ($Y_2O_3$):0.5

To form alloy MA 956, powder was first prepared by ball milling elemental powders or powders of prealloy along with yttrium oxide until a mechanically alloyed structure is attained which is suitable for thermomechanical processing. The ball milling distributes yttrium oxide substantially uniformly throughout the powder. The milling was performed in an inert atmosphere, such as argon. The powder was then introduced into a steel 5 in. ×43 in. ×43 in. (12.7 cm ×109 cm ×109 cm) can maintaining the inert atmosphere. The can was then heated to 550° F. ±50° F. (288° C. ±28° C.) and vacuum degassed for about 1 to 3 days, preferably 2 days. The vacuum was maintained at a pressure of about 100 microinches (254 micrometers) of mercury. After degassing, the can was sealed and consolidated by a hot isostatic pressing (HIP) process.

The 5 in. ×43 in. ×43 in. (12.7 cm ×109 cm ×109 cm) billet was pressed at 15,000 pounds per square inch (103 MPa) for 4 hours at 1850° F. (1010° C.). This prepares the billet for hot rolling. Hot rolling is conducted at a temperature from 1700°-2000° F. (927°-1093° C.), preferably 1850°-1950° F. (1010°-1066° C.). At this hot rolling temperature, the iron-base ODS sheet partially work hardens with partial recrystallization. The hot rolling temperature is controlled by two criteria. The lower temperature limit for hot rolling is controlled by the milling capacity or mill strength of deform the iron-base ODS alloy. The upper temperature limit is controlled by recrystallization properties of the alloy after working. Iron-base ODS alloys are difficult to induce grain growth. A proper combination of stored energy from rolling and temperature is required to induce grain growth. If too high of a hot rolling temperature is used, there will not be enough stored energy in the alloy to induce grain growth. Thus, ultimate or final sheet thickness determines the maximum hot rolling temperature that may be selected to achieve the minimum amount of stored energy for recrystallization to occur. The greater the deformation to the sheet, the more the hot rolling temperature may be increased. Initial hot rolling was used to roll the billet to the desired hot rolling width.

The billet was then decanned by grinding off the rolled can. The billet may be removed by pickling or grinding. Grinding is the preferred method for removing the can. After the can has been removed, the billet was abrasive cut to square off the corners and edges. The squared off billet was then hot rolled further in a first predetermined direction. The hot rolled billet was then abrasive cut into two pieces which were hot rolled further in a first direction. The hot rolled pieces were then abrasive cut to equally sized pieces and stacked for pack rolling. Stacks of 1-5 and preferably 2-3 sheets were pack rolled together. The surface friction between the sheets provided uniform deformation of the pack rolled iron-base ODS sheets. Ideally, two nickel sheets are used to sandwich the iron-base ODS sheets. The nickel sheets served to insulate the packed iron-base sheets preventing excess cooling upon hot rolling and allowed for greater reduction in thickness during hot rolling. In addition, the nickel sheets serve to protect the pack rolled sheets from surface defects originating from the rolling mill. Following pack rolling, the nickel buffer sheets and iron-base ODS alloy sheets were easily separated. Hot rolling to a thin thickness allowed for sufficient work hardening in the first direction to balance transverse and longitudinal properties. For example, to prepare the sheet for a final thickness of 0.02 in. (0.05 cm), the billet was hot rolled in the first direction to 0.075 in. (0.19 cm) and for a final thickness of 0.012 in. (0.03 cm) the billet was hot rolled in the first direction down to 0.055 in. (0.14 cm). The separated sheets were then abrasive cut to desired lengths for cold rolling preparation.

Prior to cold rolling the sheets were rotated to a second direction substantially perpendicular, preferably 90° from the hot rolling direction. The sheets were then cold rolled at about 150°-200° F. (65°-93° C.) down to finished size in this second direction. Cold rolling operations are preferably continuous with tension rolling equipment for improved sheet thickness control.

Figure 2:
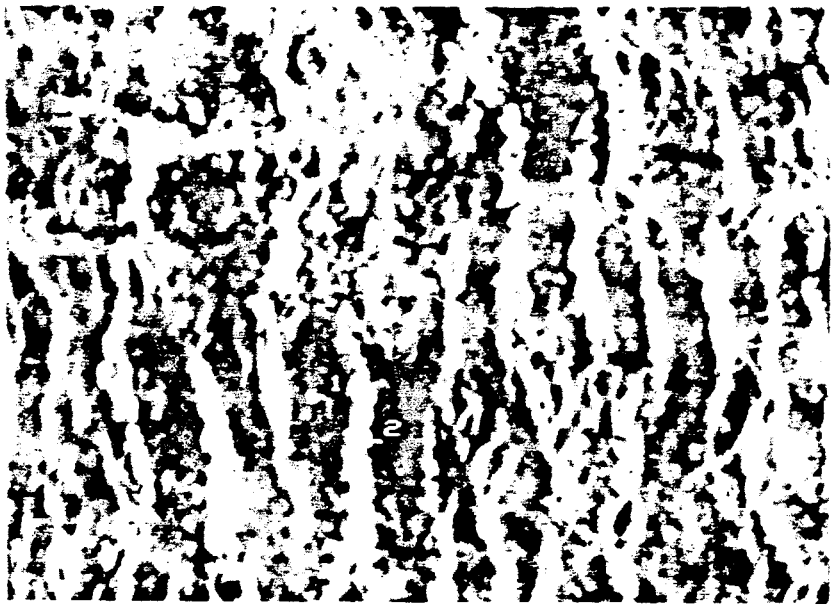
FIG. 2 is a SEM photomicrograph of the alloy of FIG. 1 after cold rolling, taken at 2600X, illustrating the breaking up of the dark oxide surface layer.
Figure 3:
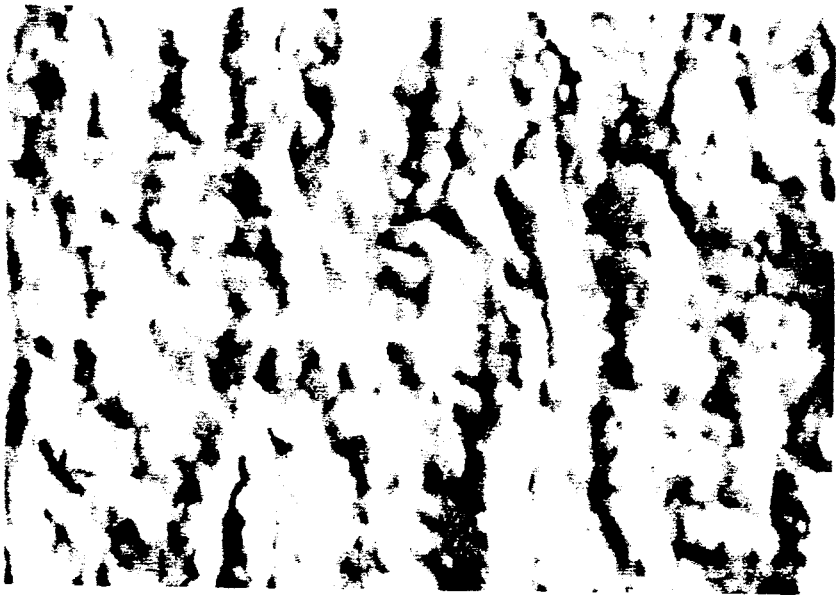
FIG. 3 is a SEM photomicrograph of the alloy of FIG. 2 after pickling, taken at 2600X, illustrating the removal of the dark oxide layer.

Optionally, for production of sheets less than 0.012 in. (0.03 cm) in thickness an anneal at 1950° F. (1066° C.) may be used for stress relief and to add ductility for further sheet thickness reduction. This annealing forms a tough adherent surface oxide, as shown in FIG. 1, which is difficult to remove by pickling. To remove the oxide, the sheet is cold rolled to break up the oxide. An illustration of the broken up oxide is shown in FIG. 2. After the oxide is broken up, the surface oxide is easily removed with a suitable pickling treatment. The preferred pickling procedure has been a two step process. First, the sheets are immersed in a 10% $H_2SO_4$ solution maintained at 160° F. (71° C.) for two minutes and rinsed. Second, the sheets are immersed in a 15% $HNO_3$-5% HF solution maintained at 130° F. (54° C.) for two minutes and rinsed with water. The as-pickled surface is shown in FIG. 3. The pickling operation, after cold rolling provides a quick method for removing strongly adherent surface oxide. After pickling, the sheets may be cold rolled in the second direction until a desired final thickness is achieved. The process of the invention may produce sheets as thin as 0.002 in. (0.05 mm). Optionally, a final anneal may be used to increase grain size for improved rupture strength. To form increased grain size for the MA 956 iron-base ODS alloy, an anneal at about 2375°-2450° F. (1300°-1343° C.) for 0.5 hour followed by air cooling is used. For the grains to grow it is critical that sufficient stored energy from hot rolling be present in the sheet.

In order to achieve optimum properties in the transverse and longitudinal directions the amount of work hardening from hot rolling is balanced with the cold work from cold rolling. Properties in both the transverse and longitudinal directions are controlled by balancing the hot rolling step with the cold rolling step. For most applications, such as turbine engine parts, it is desirable to achieve as isotropic of properties in the transverse and longitudinal directions as possible. This balancing optimizes properties in both directions to facilitate uniformity of properties in the transverse and longitudinal directions.

The process of the invention has allowed iron-base ODS sheet to be cold rolled with conventional rolling equipment. Yield has increased from 25 to 63% with the process of the invention. In addition, the process of the invention has successfully produced iron-base ODS sheet with uniform properties in the transverse and longitudinal directions. Furthermore, the invention has produced sheet with improved strength and more uniform thickness.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A method for forming sheet of iron-base ODS alloys comprising:

a) hot rolling a billet or iron-base ODS alloy in a first direction to a predetermined thickness to introduce a predetermined amount of work hardening into said billet; and b) cold rolling said work hardened metal of said billet in a second direction substantially perpendicular to said first direction after said hot rolling to form said iron-base ODS sheet of a predetermined thickness and to introduce a predetermined amount of cold work into said metal.

2. The method of claim 1 wherein said hot rolling and cold rolling are balanced to produce substantially uniform properties in the transverse and longitudinal directions.

3. The method of claim 1 including the additional step of (c) annealing said sheet of iron-base ODS alloy to reduce property directionality from previous rolling and relieve stress.

4. The method of claim 1 including the additional steps of (c) annealing said ODS sheet to increase ductility; (d) cold rolling said annealed sheet to break up oxide on said annealed sheet; and (e) pickling said cold rolled sheet to remove said oxide from said cold rolled sheet.

5. The method of claim 1 wherein pack rolling with protective layers is used during hot rolling to decrease the final thickness achievable during hot rolling and increase work hardening during hot rolling.

6. The method of claim 1 wherein said cold rolling is a continuous operation.

7. A method for forming sheet of iron-base ODS alloys comprising:

a) hot rolling a billet of iron-base ODS alloy in a first direction to a predetermined thickness to introduce a predetermined amount of work hardening into said billet; and b) cold rolling said work hardened metal of said billet in a second direction substantially perpendicular to said first direction after said hot rolling to form said iron-base ODS sheet of a predetermined thickness and to introduce a predetermined amount of cold work into said metal balanced to said hot rolling to produce substantially uniform properties in the transverse and longitudinal directions upon recrystallization.

8. The method of claim 7 including the additional step of (c) annealing said sheet of iron-base ODS alloy to reduce property directionality from previous rolling and relieve stress.

9. The method of claim 7 including the additional steps of (c) annealing said ODS sheet to increase ductility; (d) cold rolling said annealed sheet to break up oxide on said annealed sheet; and (e) pickling said cold rolled sheet to remove said oxide from said cold rolled sheet.

10. The method of claim 7 wherein pack rolling with protective layers is used during hot rolling to decrease the final thickness achievable during hot rolling and increase work hardening during hot rolling.

11. The method of claim 7 wherein said iron-base ODS alloy contains chromium, aluminum, titanium and yttrium oxide.

12. The method of claim 10 wherein said protective layers are nickel sheets.

* * * * *